United States Patent [19]

Baptist

[11] 4,053,100

[45] Oct. 11, 1977

[54] SHIPPING CARTON

[75] Inventor: Brian Kent Baptist, San Jose, Calif.

[73] Assignee: International Paper Company, New York, N.Y.

[21] Appl. No.: 719,410

[22] Filed: Sept. 1, 1976

[51] Int. Cl.[2] ..... B65D 5/22; B65D 5/30

[52] U.S. Cl. ..... 229/43; 229/45 R; 229/34 R

[58] Field of Search ..... 229/43, 45, 34 R, 23 R

[56] References Cited

U.S. PATENT DOCUMENTS

| | | | |
|---|---|---|---|
| 1,826,197 | 10/1931 | Adams | 226/6 A X |
| 2,319,924 | 5/1943 | Ferguson | 229/43 X |
| 2,721,689 | 10/1955 | Nye | 229/40 |
| 2,809,775 | 10/1957 | White | 229/34 R |
| 2,893,621 | 7/1959 | Harnish et al. | 229/34 R |
| 3,197,108 | 7/1965 | Northway | 229/23 R |
| 3,520,468 | 7/1970 | Wiemann | 229/45 |
| 3,623,650 | 11/1971 | Watts | 229/45 X |
| 3,695,219 | 10/1972 | Arian et al. | 118/50 |
| 3,899,121 | 8/1975 | Herbetko | 229/43 X |

*Primary Examiner*—Davis T. Moorhead
*Attorney, Agent, or Firm*—Charles B. Smith

[57] ABSTRACT

A shipping carton for storage and transport of produce under cold and humid conditions comprising a tray and a cover. The tray has stacking tabs extending upwardly from its top corners and is formed by bottom, end, and side panels secured together by flaps extending between the panels. The cover, adapted to fit over the top of the tray to close the carton, has portions defining openings through which the stacking tabs extend when the carton is closed, whereby a second carton stacked on the closed carton is essentially prevented from shifting.

5 Claims, 9 Drawing Figures

FIG. 3
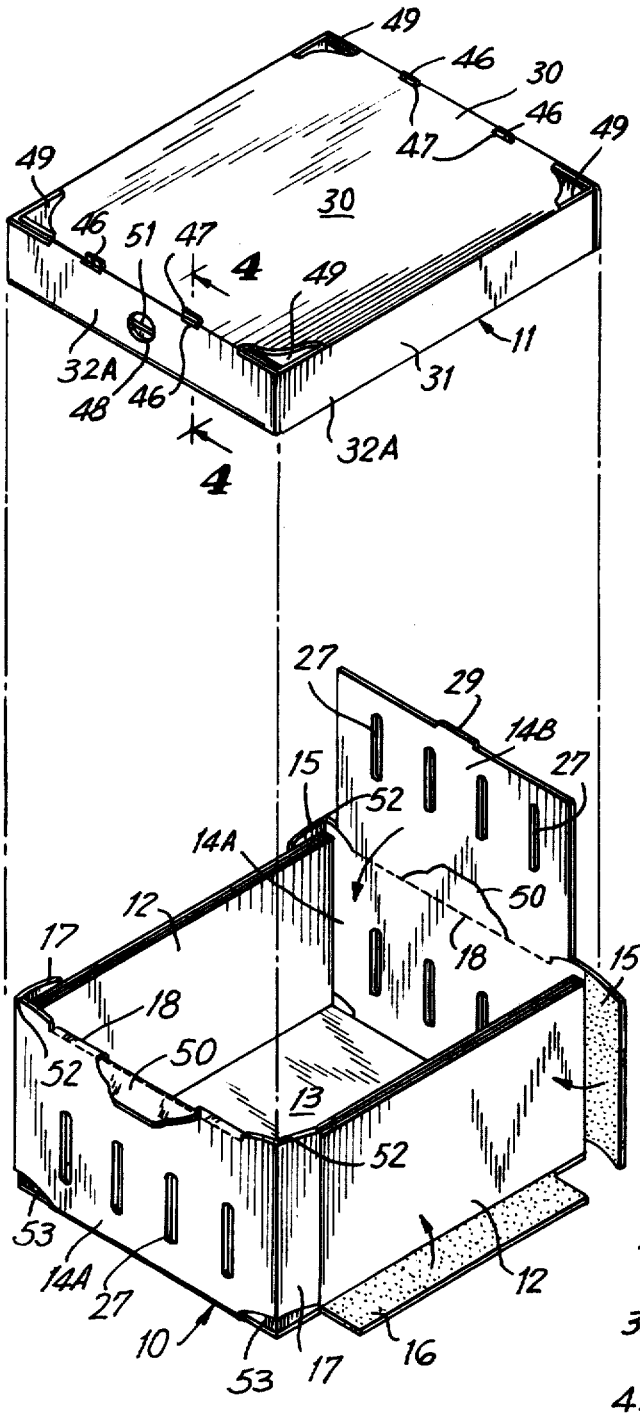
FIG. 6
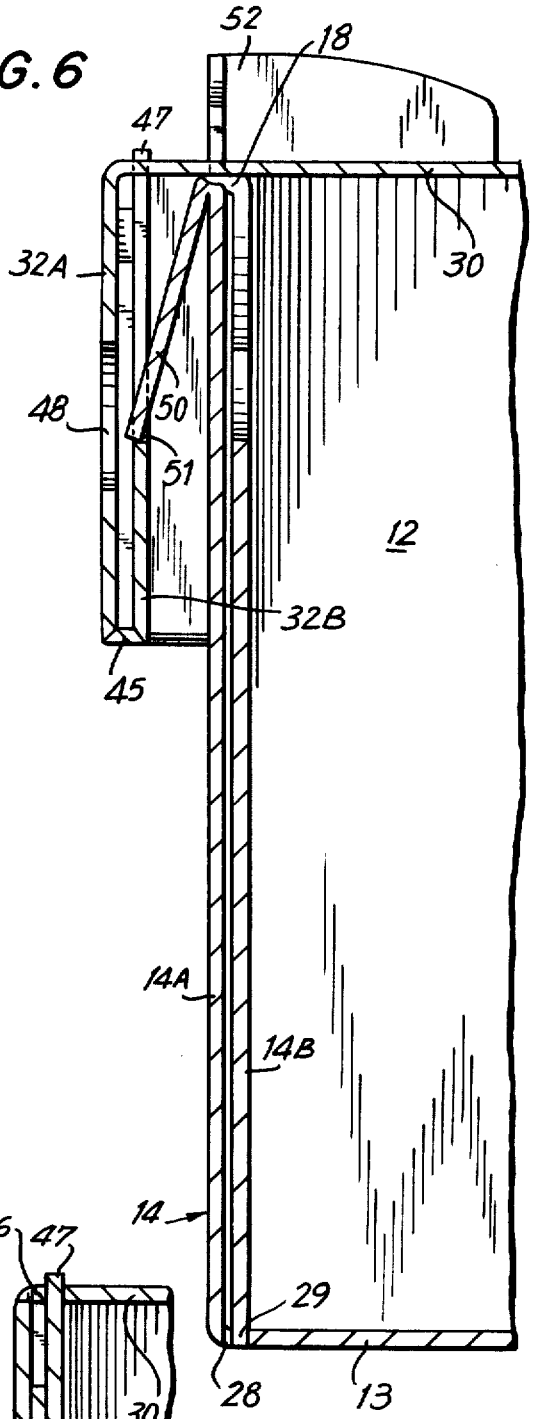
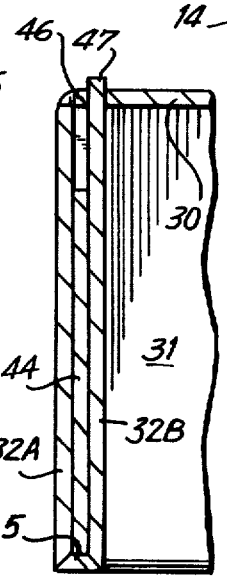
FIG. 4

SHIPPING CARTON

RELATED APPLICATION

My copending application Ser. No. 713,195 filed Aug. 10, 1976, which is a continuation-in-part of application Ser. No. 576,717 filed May 12, 1975, discloses stacking tabs similar to those disclosed herein but in a carton of different construction.

This invention relates to ventilated shipping cartons having high stacking strength and, more particularly, to such cartons for transporting produce such as fruits, vegetables, and particularly grapes, which for any of a variety of reasons must be cooled or maintained at a certain temperature during transit.

It is known that many fruits and vegetables respire and generate heat at different rates even after they have been harvested. It is also known that heat accelerates the deterioration of fruits and vegetables, which may create problems in the long periods of time and distances that often must be negotiated before such commodites reach the marketplace. This is usually combated by cooling the produce to a desired temperature and maintaining this temperature in storage and transit. This temperature is often well below 50° F. and is maintained under highly humid conditions (usually greater than 90% relative humidity), so that the produce does not become dehydrated. This cooling to establish a desirable temperature is achieved and maintained by a variety of methods, which are known in the art, with the common denominator of these methods being that relatively cold, highly humid conditions must be maintained from the time of harvesting the produce until its deliverance to the marketplace. Thus, one requirement of a carton utilized for shipping such commodities is that the carton be capable of maintaining the commodities at a desired temperature and humidity.

A second requirement of such a carton is that the carton be capable of stacking for long periods of time under the above-described conditions. At the present time, the wood box lug and various derivatives thereof, i.e., wood and veneer combinations, are widely used in the construction of produce shipping boxes. These wood boxes are commonly ventilated and offer ample protection to the produce packed therein due to the basic properties of wood, i.e., structural strength that does not appreciably deteriorate under long periods of stacking, subjection to high weights, and the above described conditions of temperature and humidity. Wood boxes, although possessing structural qualities advantageous in storing and shipping produce, have several shortcomings. For example, if shifting during the handling and transit of these wood boxes is not restricted, misalignment of the boxes and the ventilation apertures therein may restrict air passage in and out of the boxes which would prevent maintaining a desired temperature of the commodities packed in the boxes. Further, the cost of wood boxes, the greater weight of boxes constructed of wood rather than other materials, and the availability of wood as a raw material in light of the desirability of reducing the consumption of this natural resource, present further disadvantages in constructing shipping cartons from wood. In addition, wood cartons present a greater hazard of injury due to wood splinters and the nails used to construct such boxes.

It has been known to avoid such disadvantages by constructing shipping cartons of corrugated paperboard as an alternative to wood. Although corrugated paperboard cartons eliminate some of these disadvantages, they also possess certain disadvantages. For example, corrugated paperboard cartons generally lack the basic structural strength of wood boxes to support great weights for long periods of time and long distances. Secondly, under the above-discussed conditions of temperature and humidity, corrugated paperboard cartons more readily lose their structural integrity; and consequently, the capability of these cartons to be stacked is restricted. The ability to stack many cartons in a storage or transit vehicle for long periods of time, while maintaining a desired temperature of the commodities packed therein, is vital to a grower and/or packer. Heretofore a one-piece corrugated paperboard carton has not been found to be completely satisfactory in accomplishing these objectives. Also, the longer these cartons are subjected to cold, humid conditions, the greater the reduction in their stacking strength and ability to protect and maintain at a desired temperature the commodities being stored and/or shipped.

With the aforementioned disadvantages in mind, it is a general object of this invention to provide an inexpensive, but strong, shipping carton capable of being stacked under extreme requirements of temperature and humidity while in storage and/or transit, as will most wooden boxes, and capable of allowing adequate ventilation of the commodities being stored or transported, without sacrificing any of the advantages corrugated paperboard cartons possess over their counterpart wood boxes.

It is another object of this invention to provide a shipping carton having top to bottom stacking strength comparable to that of a wood box, which is maintained even under conditions of extreme temperature and humidity for long periods of time.

It is a further object of this invention to provide a shipping carton having means for maintaining a particular stacking arrangement to insure that air may be circulated through the carton to maintain the commodities packed therein at a desired temperature.

In this last regard, it has been known in the prior art to provide on the cover of a carton stacking tabs at the corners of the cover to prevent shifting of a second carton stacked thereon. However, it has been found that this type of stacking tab does not have adequate strength to prevent its own deformation by the stacked carton, which in turn may lead to undesirable carton shifting. The cartons of the present invention are "bolstered" in several ways, as described in detail below, so as not to easily deform.

These and other objects of this invention will be apparent to one skilled in the art from a consideration of this entire disclosure including the accompanying drawings.

SUMMARY OF THE INVENTION

The above objects are accomplished in accordance with this invention by providing a shipping carton including a tray and a cover. Prior to erection of the tray, it lies flat for economy of storage of several of these trays. To erect the tray, it is bent along fold lines between its portions and, in particular embodiments of this invention, separate pieces that serve as selected panels of the tray are positioned within openings formed in the erected tray and are secured to the tray.

The tray of the shipping carton of the present invention includes upwardly extending stacking tabs and the cover, being adapted to fit over the top of the tray to close the carton, includes portions defining openings through which the stacking tabs extend when the carton is closed. Thus, a second carton stacked on the closed carton is essentially prevented from shifting by the stacking tabs. The stacking tabs extend upwardly from at least two diagonally opposite top corners of the tray and are adapted to engage the bottom corners of the second carton. In particular embodiments of the shipping carton of this invention, cut-out areas, corresponding to the structure of the stacking tabs, are provided generally adjacent the bottom corners of the tray, whereby the stacking tabs of the carton mate with similar cut-out areas of the second carton stacked thereon to prevent relative shifting of the cartons.

In particular embodiments, the tray includes a bottom panel, end panels, side panels, and flaps extending from selected ones of the panels to secure the selected panels to the other panels, and the stacking tabs each extend upwardly above the top of the tray jointly from an end panel and the flap extending from the end panel.

Several other features of the shipping cartons of the present invention contribute to the stacking strength capability of these cartons, the capability of these cartons to maintain produce packed therein at a constant, preferably cool, temperature, and the capability of these cartons to maintain their intended stacking arrangement without shifting of the stacked cartons. For instance, as mentioned above, separate pieces are utilized preferably for either side or end panels of the tray of this carton. These pieces are constructed of a multi-wall, corrugated board impregnated with a moisture resistant agent. Another feature which contributes to the stacking strength capability of the cartons is the double wall character of either the end or side panels, which panels include two abutting walls integrally connected by a fold line. To maintain a desired, cool temperature in these cartons, apertures are provided in the end panels, which apertures are preferably elliptical in shape and are in alignment. The cut-out areas mentioned above also contribute to ventilation through the carton, which helps maintain a desired temperature therein. Also, means for releasably locking the cover to the tray when the carton is closed are provided.

BRIEF DESCRIPTION OF THE DRAWINGS

FIG. 3 is a perspective view of the cover and tray of FIGS. 1 and 2 showing the cover in its erected condition and the tray in a partially erected condition.

FIG. 4 is a sectional view of the cover of FIG. 3 taken along line 4—4 of FIG. 3.

FIG. 6 is a sectional view of the carton illustrated in FIG. 5 taken along line 6—6 of FIG. 5, which shows particularly the releasable locking engagement of the cover with the tray.

DESCRIPTION OF THE PREFERRED EMBODIMENTS

Figure 2:
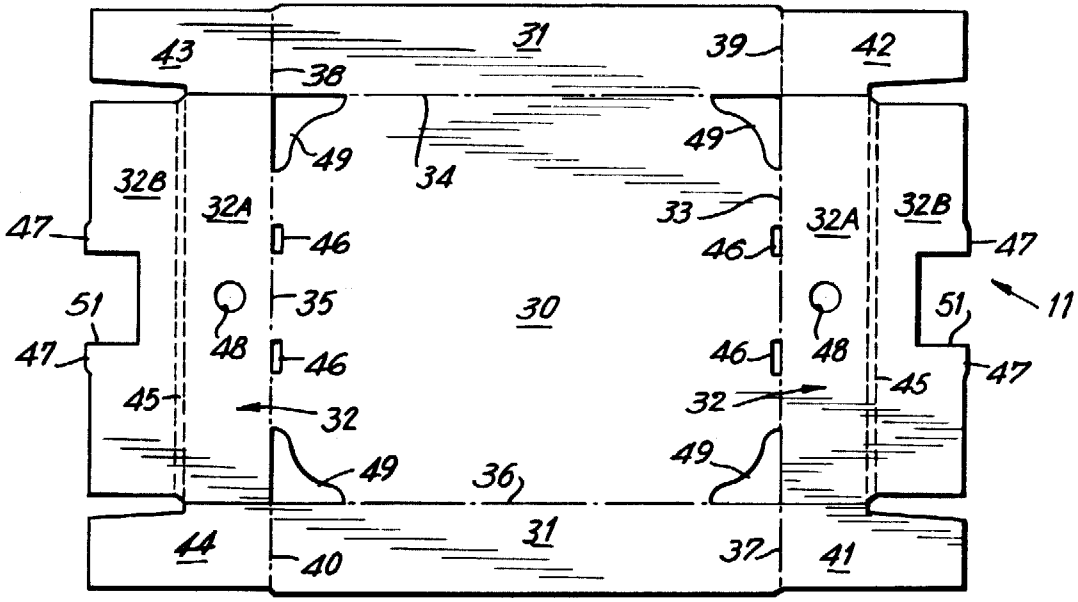
FIG. 2 is a plan view of the cover of one embodiment of the shipping carton of this invention.

A preferred embodiment of the shipping carton of this invention is described below with reference to FIGS. 1–9. As shown in FIG. 3, the carton includes a tray, generally designated 10, and a cover, generally designated 11. The tray and cover are preferably constructed of corrugated paperboard, although if desired, other materials known in the art may be utilized. Additionally, in this preferred embodiment, separate pieces 12 of multi-wall, corrugated paperboard are utilized as side panels of tray 10, which pieces will be discussed in greater detail below. The blanks from which tray 10 and cover 11 are made are illustrated in FIGS. 1 and 2 respectively.

Figure 1:
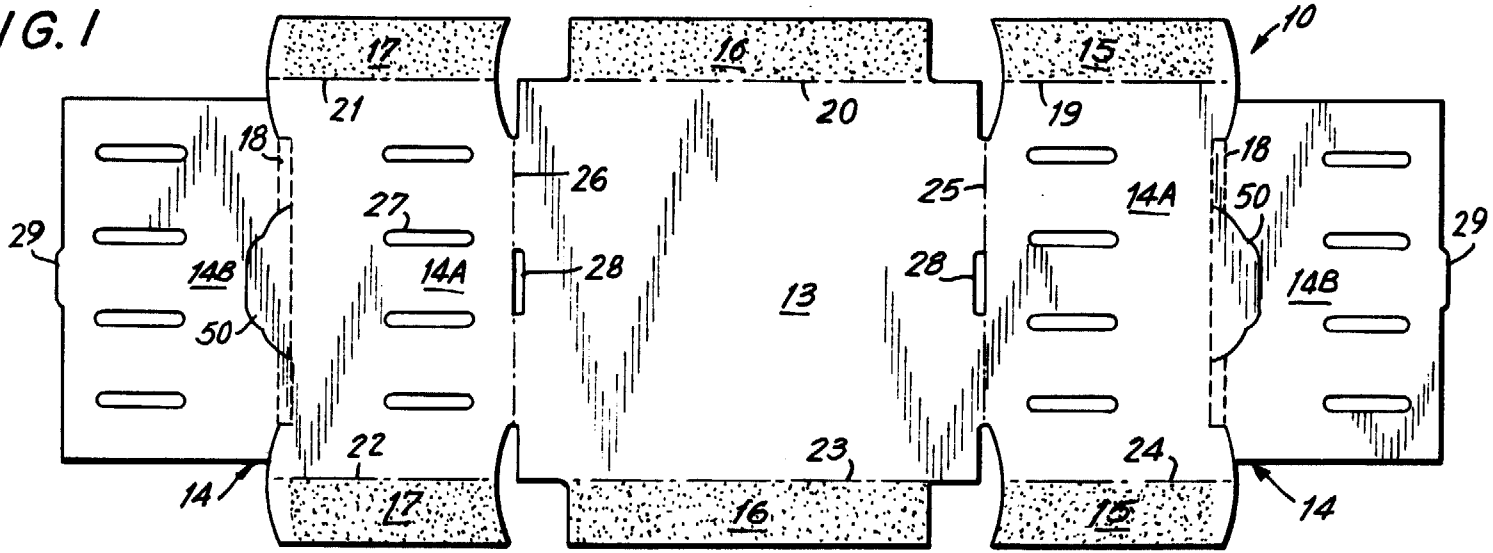
FIG. 1 is a plan view of the tray of one embodiment of the shipping carton of this invention.

Referring to FIG. 1, the blank of tray 10 includes a bottom panel 13, end panels 14, and various flaps 15–17 extending from and integrally connected with the bottom and end panels by fold lines 19–24. Additionally, end panels 14 are integrally connected to bottom panel 13 by fold lines 25 and 26. It is to be understood that the terms "end" and "side" are interchangeably used in this application and are not to be employed in a limiting sense. Again referring to FIG. 1, end panels 14 each include two walls, 14A and 14B, integrally connected by a fold line 18. Provided in each end panel 14 are apertures 27. Slots 28 are defined by portions of bottom panel 13 adjacent the fold lines between the bottom panel and walls 14A of each panels 14. At a similar position on walls 14B, locking tabs 29 are provided on the free edges of these walls. The significance of slots 28 and locking tabs 29 will be apparent from the discussion below.

Cover 11, shown in FIG. 2, when erected is adapted to fit over the top of tray 10 to close the carton. The blank from which cover 11 is made includes a top panel 30, side panels 31, and end panels 32. The side and end panels are integrally connected with top panel 30 by fold lines 33–36. Integrally connected to side panels 31 by fold lines 37–40 are flaps 41–44. Similar to end panels 14 of tray 10 discussed above, end panels 32 of cover 11 also each include two walls, in this case 32A and 32B, integrally connected by a fold line 45. Thus each panel 32 includes a first wall 32A adjacent top panel 30 and a laterally outward wall 32B. Also similar to slots 28 and locking tabs 29 in tray 10, slots 46 and locking tabs 47 are provided in cover 11, as illustrated in FIG. 2.

Again looking at FIG. 2, it is apparent that a central section of each wall 32B is recessed. Adjacent the recess in each wall 32B, in each wall 32A a hole 48 is provided. Additionally, generally triangular shaped spaces 49 are provided at each corner of panel 30. Now looking again at FIG. 1, at similar positions on fold lines 18 between the walls of each end panel 14 in tray 10, an ear 50 extends outwardly. The significance of these above mentioned structures will be readily understood from the discussion below concerning the erection of tray 100 and cover 11 to form the shipping carton of this invention.

To erect tray 10, end panels 14 are folded upwardly, separate side panels 12 are inserted within the partially erected tray, and flaps 15–17 are folded inwardly and secured to side panels 12, as shown in FIG. 3. Additionally, walls 14B of each panel 14 are folded downwardly and secured to adjacent walls 14A. Preferably this securement is effected by insertion of locking tabs 29 in openings 28, which is best seen in FIG. 6. Flaps 15–17 are preferably secured to side panels 12 by being glued thereto.

Figure 5:
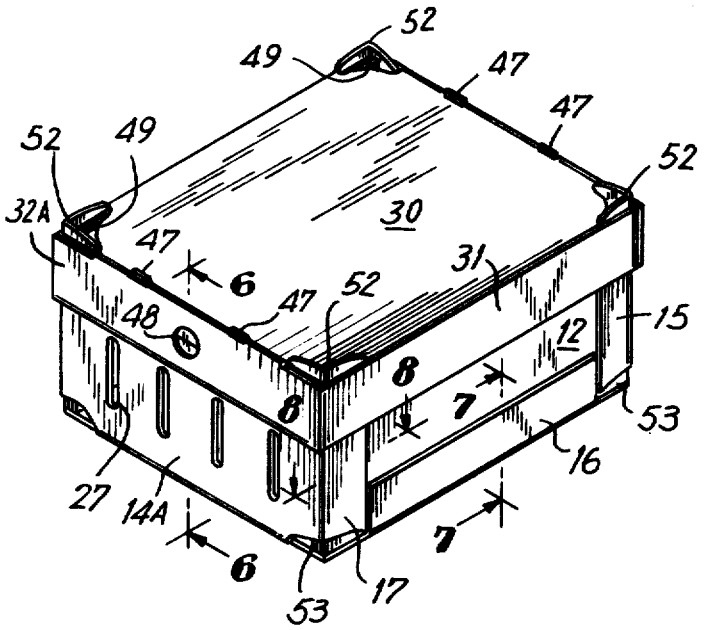
FIG. 5 is a perspective view of the cover of FIG. 3 placed over the tray of FIG. 3 to close the carton of this embodiment.

To erect cover 11, side and end panels 31 and 32 are folded downwardly from top panel 30, flaps 41–44 are folded inwardly, and walls 32B are folded along lines 45 upwardly against walls 32A. Again, the walls are secured together by insertion of locking tabs 47 through slots 46 in top panel 30, which is best seen in FIG. 4. The carton of this invention made from the erected tray 10 and cover 11 is best shown in FIG. 5.

Several features of this carton are apparent from the drawings. First, it is believed that in part, superior stacking strength of this carton is achieved because flaps 15–17 are essentially rectangular as shown in FIG. 5. This is important because the height of particularly flaps 15 and 17 is substantially equal to the height of the carton. In other words, flaps 15 and 17 extend from end panels 14 the full height of side panels 12 between bottom panel 13 and the top of the tray. This provides a relatively long glue line from the top to the bottom of the tray which aids in the stacking strength of the carton. Secondly, apertures 27 in end panels 14 are in alignment. It has been found that by placing apertures 27 in each of the end panels 14 at approximately the same position, that ventilation and closing, if desired, of the contents within the carton is enhanced because of the straight through flow of air from apertures 27 in one end panel 14 to apertures 27 in the other panel 14. Preferably, elliptical shaped apertures are utilized because they provide the greatest amount of ventilation and the smallest reduction in stacking strength, i.e., elliptical apertures minimize the extent to which the cross sectional area of the panels is reduced. Also, visibility of more than one layer of produce packed in the tray is allowed as compared to having circular or some other shape of aperture. Although this shipping carton has been illustrated having four apertures in each panel 14, it is within the scope of this invention that the number of apertures be increased or decreased to fulfill the particular requirements of ventilation and/or cooling of the produce packed within the carton. Also, although alignment of the apertures on each side panel has been found to be preferred, any other arrangement of the apertures may be utilized to accomplish the particular desired objective without departing from the spirit of this invention.

Figure 9:
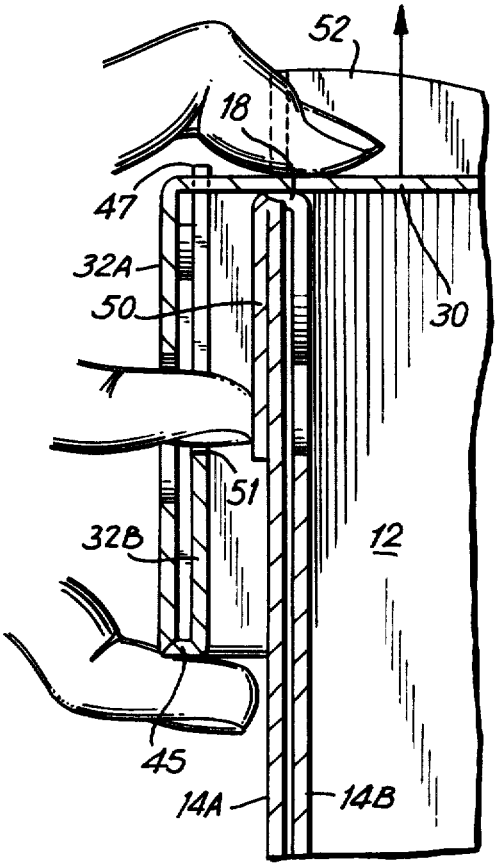
FIG. 9 is a view similar to FIG. 6 showing the operation of removing the cover from its releasable locking engagement with the tray in the carton illustrated in FIG. 6.

Another feature of the carton of this invention which is particularly shown in FIG. 6 are the means for releasably locking cover 11 to tray 10 when the carton is closed. These means include ears 50 extending outwardly from each panels 14, sleeves 51 defined in walls 32B of end panels 32, and holes 48 in walls 32A of these same end panels. Looking at FIG. 6, upon placing cover 11 onto tray 10 as shown in FIG. 5, ears 50 engage sleeves 51, so that cover 11 cannot be removed from tray 10. As schematically shown in FIG. 9, by insertion of a finger through each hole 48 and application of finger pressure against ears 50, the ears are released from their engagement with sleeves 51, so that the cover can be removed from the tray.

Another feature of the shipping carton of this invention is the multi-wall panels in the carton, which add to the stacking strength and integrity of the carton under particularly conditions of extreme temperature and humidity. It is contemplated that the panels of this carton could be single walled or that side panels 12 could be replaced by panels similar to end panels 14, which would be double walled and integrally connected to bottom panel 13. It is also contemplated that the panels of the carton can be secured together other than by flaps 15–17, but as mentioned above, these flaps also add to the stacking strength capability of the carton.

Side panels 12 are preferred because they greatly enhance the stacking strength capability of this carton. It is preferred that panels 12 be of a triplewall construction. It is further preferred that these panels be manufactured from corrugated paperboard having three mediums enclosed by four facings. As discussed above, under conditions of humidity and cold in which produce is stored and transported, a shipping carton must not only be capable of maintaining the produce packed therein at a desired temperature, but also must be capable of maintaining its stacking strength or top to bottom compression strength under such conditions for long periods of time. It has been found that the stacking strength of the cartons of the present invention can be maintained and is enhanced by impregnation of the panels 12 with one or more moisture resistant agents. It has been found that by impregnating at least the mediums and interior facings of the corrugated paperboard used in forming these panels with an agent comprising a blend of a polymeric heat curable resin, a paraffinic wax, an amount of a catalyst sufficient to effectuate curing of the resin, water, and an organic liquid carrier, that the wet strength of these cartons is increased. The impregnated board typically contains from about 4 to about 50%, by weight, and preferably from about 8 to about 20%, by weight, of agent. Several known apparatus and methods useful in improving the wet strength of corrugated paperboard cartons can be used to impregnate, as described above, the panels. Further, several impregnates may be utilized which impart wet rigidity to the shipping cartons of this invention. One particularly useful impregnate includes a urea-formaldehyde resin, a paraffinic wax, a minimum amount of a catalyst to effectuate curing of the urea-formaldehyde resin, with the remainder of the composition being a mixture of water and an alcohol. If preferred, tray 10 or cover 11 may also be impregnated with, for example, a wax or any of the agents suggested above.

The shipping cartons of the present invention additionally include means for insuring the correct stacking of one carton upon another to prevent the relative shifting of the cartons and additional means for ventilating the carton to maintain the desired temperature of the produce packed therein. As shown in FIG. 3, tray 10 includes stacking tabs 52 extending upwardly from its top corners and cover 11 includes openings 49 through which stacking tabs 52 extend when the carton is closed, whereby a second carton stacked on the closed carton is essentially prevented from shifting. Although it is not necessary that stacking tabs 52 be provided at each top corner of tray 10 to accomplish this function, the tabs should extend upwardly from at least two diagonally opposite top corners of the tray. It has been found that stacking tabs which are shorter in height and longer in base are less susceptible to damage during stacking and less bendable, which provides better alignment of the stacked cartons and more dependable stacking. Tabs 52 are essentially V-shaped and each tab extends upwardly jointly from an end panel and the flap extending from the end panel at a top corner of the tray.

Although stacking tabs 52 of one carbon could be constructed to rest upon the outer surface of a carton stacked thereon and engage the bottom corners of the stacked carton, it has been found that by providing cut-out areas 53, corresponding to the structure of the tabs, generally adjacent the bottom corners of tray 10, stacking tabs 52 of one carton mate with cut-out areas 53 of the carton stacked thereon to prevent relative shifting of the cartons. These cut-out areas also serve another function. When several of the cartons are in a stacked arrangement, ventilation around the perimeter of and through the cartons is enhanced because of these cut-out areas. This prevents "hot spots" in the most difficult areas of the cartons to ventilate, their corners. However, if desired, cutout areas 53 may be eliminated so that the flaps 15 and 17 extend the full height of side panels 12. Further in connection with ventilating the cartons of the present invention, spaces 49 at the corners of top panel 30 of cover 11 adjacent each stacking tab 52 provide additional ventilation through the carton.

Figure 7:
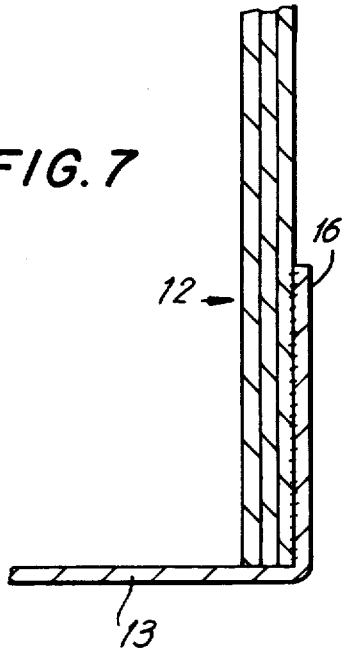
FIG. 7 is a sectional view of the carton illustrated in FIG. 5 taken along line 7—7 of FIG. 5.
Figure 8:
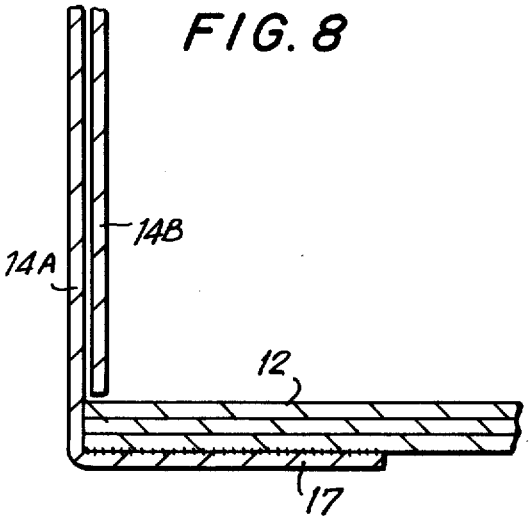
FIG. 8 is a sectional view of the carton illustrated in FIG. 5 taken along line 8—8 of FIG. 5.

It has been found that the stacking strength capability of the cartons of the present invention and the capability of these cartons to prevent shifting when in a stacked arrangement is unexpectedly enhanced because of the cooperation between stacking tabs 52 and side panels 12. As shown in FIGS. 7 and 8, side panels 12 snugly fit within the erected tray to abut against both bottom panel 13 and end panels 14. Because of thhe multi-wall nature of side panel 12 and the other factors mentioned above which contribute to its strength, side panels 12 bolster the corners of the carton, which helps in preventing deformation of the stacking tabs 52 by one carton placed upon another. Somewhat in the same manner, the double walls of end panels 14 also bolster stacking tabs 52. Essentially, rather than the stacking tabs having no support from the remainder of the carton, as would be the case if the stacking tabs originated on the cover of the carton, the structure of tray 10 described above contributes to the stacking capability of these tabs to maintain the cartons in an intended arrangement without substantial shifting.

These and other embodiments of the shipping cartons of the present invention will be apparent to those skilled in the art in view of this disclosure.

What is claimed is:

1. A shipping carton adapted for storage and transport of produce under cold and humid conditions comprising a tray and a separate cover adapted to fit over the top of the tray to close the carton, said tray comprising:

a rectangular botton panel, a pair of double-wall end panels each comprising an outer wall integrally connected with one of the opposite ends of the bottom panel by a fold line along which said outer wall is folded to extend vertically upward from said bottom panel and an inner wall connected with said outer wall by a fold line defining the upper margin of said end panel and along which said inner wall is folded inwardly of said tray to lie substantially in face-to-face contact with the inner surface of said outer wall, a pair of substantially rigid side panels separate from the bottom and end panels and each comprising a plurality of adhesively united corrugated mediums and facing boards, a pair of bottom panel flaps each integrally connected with one side margin of said bottom panel by a fold line along which said flap is folded upwardly to lie upon the outer surface of one of said separate side panels thus to secure said bottom panel to both of said side panels with said side panels extending vertically upwardly from said bottom panel, four end panel flaps each integrally connected with one vertically extending side margin of each of said outer walls of said double-wall end panels by a fold line along which said flap is folded to lie upon the outer surface of one of said separate side panels with the inner surface of the inner wall of the adjacent double-wall end panel extending in contact with the adjacent end margin of said side panel thus to secure said outer walls of each of said double-wall end panels to opposite ends of both of said side panels, each of said four end panel flaps extending vertically in secured contact with the adjacent end of one of said side panels from substantially the level of said bottom panel to the top margin of said side panel, and stacking tabs extending upwardly from at least two diagonally opposite top corners of said tray each of said stacking tabs being formed integrally with and extending jointly upwardly from an end panel flap and an adjacent portion of an outer wall of said double-wall end panels, each of said stacking tabs being V-shaped and being bolstered for rigidity by the inner walls of said end panels and by the opposite ends of said separate side panels, the outer walls only of each of said double-wall end panels and each of said four end panel flaps connected therewith having cut-out areas corresponding with said stacking tabs and positioned at the bottom corners of said tray whereby the stacking tabs of said tray will mate with similar cut-out areas in a second similar tray to be stacked thereupon, and said cover comprising;

portions defining openings through which said stacking tabs extend when the carton is closed whereby the bottom panel of a second similar carton stacked on the closed carton rests upon the top of said cover of said closed carton and lies between said diagonally opposed stacking tabs of said closed carton to essentially prevent said second carton from shifting relative to the tray of said closed carton.

2. The carton of claim 1 wherein the side panels have at least the mediums and interior facings thereof impregnated with a moisture resistant agent.

3. The carton of claim 2 wherein the moisture resistant agent comprises a blend of a polymeric heat curable resin, a paraffinic wax, an amount of a catalyst sufficient to effectuate curing of the resin, water, and an organic liquid carrier.

4. The carton of claim 1 further comprising means for releasably locking the cover to the tray when the carton is closed.

5. The carton of claim 4 wherein the means are ears extending outwardly from selected opposite panels of the tray and sleeves in similar opposite portions of the cover, which ears engage the sleeves when the carton is closed and are releasable through holes in the cover adjacent the sleeves to remove the cover and open the carton.

* * * * *